US010837443B2

(12) United States Patent
Jenkins et al.

(10) Patent No.: US 10,837,443 B2
(45) Date of Patent: Nov. 17, 2020

(54) LIQUID RING FLUID FLOW MACHINE

(71) Applicant: General Electric Company, Schenectady, NY (US)

(72) Inventors: Sean Craig Jenkins, Haimhausen (DE); Vittorio Michelassi, Munich (DE)

(73) Assignee: Nuovo Pignone Tecnologic - SRL, Florence (IT)

( * ) Notice: Subject to any disclaimer, the term of this patent is extended or adjusted under 35 U.S.C. 154(b) by 1056 days.

(21) Appl. No.: 14/568,564

(22) Filed: Dec. 12, 2014

(65) Prior Publication Data

US 2016/0169226 A1 Jun. 16, 2016

(51) Int. Cl.
*F04C 19/00* (2006.01)

(52) U.S. Cl.
CPC ..... *F04C 19/00* (2013.01); *F04C 19/004* (2013.01); *F04C 2230/91* (2013.01)

(58) Field of Classification Search
CPC ..... F04C 19/00; F04C 19/004
See application file for complete search history.

(56) References Cited

U.S. PATENT DOCUMENTS 1,668,532 A 5/1928 Stewart et al.
2,937,499 A * 5/1960 Klemt ..... F04C 19/002 123/234
3,551,067 A * 12/1970 Wissman ..... F04D 29/126 415/134
3,973,510 A 8/1976 McCulloch et al.
4,016,894 A 4/1977 Baldwin et al.
4,422,832 A * 12/1983 Haavik ..... F04C 19/00 417/68
4,474,852 A * 10/1984 Craig ..... C02F 1/681 427/204
4,484,457 A * 11/1984 Mugele ..... F04C 23/005 417/69
5,197,863 A 3/1993 Dardis et al.
(Continued)

FOREIGN PATENT DOCUMENTS

JP 09195983 A 7/1997

OTHER PUBLICATIONS

Xiong et al., "Hydrophobic Surface and Its Application to Drag Reduction", Progress in Chemistry, 2008, URL: WWW.CNKI.com, Abstract only, Downloaded on Dec. 12, 2014 3 Pages.
(Continued)

*Primary Examiner* — Kenneth Bomberg
*Assistant Examiner* — Michael L Sehn
(74) *Attorney, Agent, or Firm* — Baker Hughes Patent Organization

(57) ABSTRACT

A liquid ring fluid flow machine is presented. The machine includes a stationary annular housing having an outer surface and an inner surface. The inner surface defines a chamber that is arranged to receive a liquid. A rotor having a core and a plurality of radially extending vanes is eccentrically rotatably mounted within the chamber for directing the liquid into a recirculating liquid ring in proximity to the inner surface of the housing within the chamber. The inner surface of the housing that is in contact with the recirculating liquid ring is covered by a hydrophobic coating. The machine further includes a first supply pipe and a second supply pipe, each in fluid communication with the chamber.

6 Claims, 1 Drawing Sheet

(56) References Cited

U.S. PATENT DOCUMENTS

| | | | | |
|---|---|---|---|---|
| 5,476,056 | A * | 12/1995 | Tokunaga | B63B 1/38 114/67 A |
| 5,636,523 | A | 6/1997 | Assaf | |
| 5,722,255 | A * | 3/1998 | Brasz | F04C 19/004 62/116 |
| 6,056,856 | A | 5/2000 | Graf | |
| 7,465,375 | B2 | 12/2008 | Demers et al. | |
| 8,172,364 | B2 | 5/2012 | Xie et al. | |
| 9,083,864 | B2 * | 7/2015 | Reed | G03B 17/02 |
| 2009/0290993 | A1 * | 11/2009 | Assaf | F01C 17/02 417/68 |
| 2010/0330340 | A1 | 12/2010 | Rothstein et al. | |
| 2011/0142607 | A1 * | 6/2011 | Ciro | F04D 29/023 415/200 |
| 2011/0194950 | A1 * | 8/2011 | Shenoi | F04C 19/00 417/54 |
| 2011/0212297 | A1 * | 9/2011 | Dhinojwala | B81C 1/00111 428/142 |
| 2012/0324886 | A1 * | 12/2012 | Assaf | F01C 7/00 60/641.2 |
| 2014/0137976 | A1 | 5/2014 | Miller et al. | |

OTHER PUBLICATIONS

Su et al., "Toward Understanding Whether Superhydrophobic Surfaces Can Really Decrease Fluidic Friction Drag", Langmuir Article, 26 (8), 2010, pp. 6048-6052.

* cited by examiner

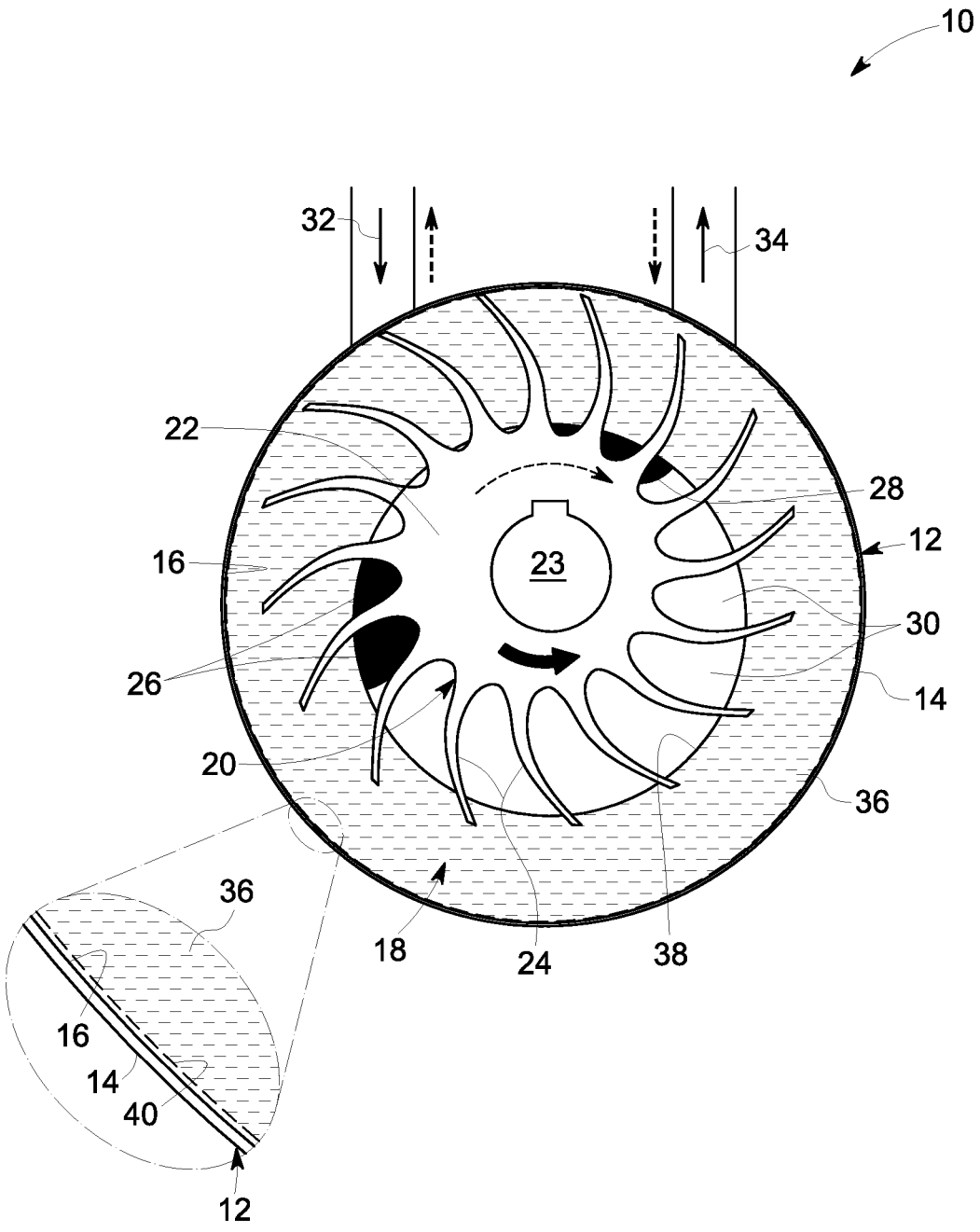
10
32
34
22
28
12
16
23
30
26
14
20
36
36
18
24
38
16
14
40
12

LIQUID RING FLUID FLOW MACHINE

BACKGROUND

The invention relates generally to a liquid ring fluid flow machine, for example, a compressor. More particularly, this invention relates to a liquid ring fluid flow machine with improved efficiency.

Liquid ring compressors are well known, in which a ring of liquid co-rotates with an impeller or rotor eccentrically disposed within a housing to obtain the necessary pumping action to compress a gas. In such compressors, it is well known that a major cause of an energy loss is fluid friction between the liquid ring and the housing. The energy loss due to such fluid friction is proportional to the square or an even higher power of the velocity difference between the liquid ring and the housing. To reduce such fluid friction losses, it has been proposed to rotate the housing about its central axis as the rotor and the liquid ring rotate about the rotor axis (see, for example, Stewart U.S. Pat. No. 1,668,532). This leads to some complex and costly structures, and has not been proven to be commercially viable.

Another approach to reduce the fluid friction losses of the type described above, has been to provide a substantially cylindrical hollow liner inside the periphery of the housing (see, for example, U.S. Pat. No. 5,197,863). The housing is stationary, but the liner is free to rotate with the liquid ring. The liquid is free to flow into or is pumped into an annular clearance between the liner and the housing. While the known rotating liner structures are simpler than the rotating housing structures, the rotating liner structures are not believed to reduce fluid friction losses as much as the rotating housing structures.

It would be desirable to have liquid ring fluid flow machines that exhibit reduced fluid friction, and thus improved efficiency.

BRIEF DESCRIPTION OF THE INVENTION

One embodiment of the invention is directed to a liquid ring fluid flow machine. The machine includes a stationary annular housing having an outer surface and an inner surface. The inner surface defines a chamber that is arranged to receive a liquid. A rotor having a core and a plurality of radially extending vanes, is eccentrically rotatably mounted within the chamber for directing the liquid into a recirculating liquid ring in proximity to the inner surface of the housing within the chamber. The inner surface of the housing that is in contact with the recirculating liquid ring is covered by a hydrophobic coating. The annular housing defines a compression zone where edges of the vanes rotate in an increasing proximity to the inner surface of the housing and an expansion zone where the edges of the vanes rotate in a decreasing proximity along the inner surface of the housing. The machine further includes a first supply pipe and a second supply pipe, each in fluid communication with the chamber.

DRAWINGS

These and other features and aspects of the present invention will become better understood when the following detailed description is read with reference to the accompanying drawing.

FIG. 1 is a perspective view of a liquid ring fluid flow machine, in accordance with one embodiment of the invention.

DETAILED DESCRIPTION

The embodiments described herein relate to liquid ring fluid flow machines. While liquid ring machines are usually gas compressors, these can also be used as expanders. The following description of embodiments is merely exemplary in nature and is in no way intended to limit the invention, its application, or uses. Liquid ring compressors/expanders are applicable to various industries, for example power, oil and gas, chemical, mining, marine, paper, and food industries.

Approximating language, as used herein throughout the specification and claims, may be applied to modify any quantitative representation that could permissibly vary, without resulting in a change in the basic function to which it is related. Accordingly, a value modified by a term or terms, such as "about," is not limited to the precise value specified. In some instances, the approximating language may correspond to the precision of an instrument for measuring the value.

In the following specification and claims, the singular forms "a", "an" and "the" include plural referents unless the context clearly dictates otherwise. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable.

The terms "comprising," "including," and "having" are intended to be inclusive, and mean that there may be additional elements other than the listed elements. As used herein, the term "and/or" includes any and all combinations of one or more of the associated listed items. The terms "first", "second", and the like, as used herein do not denote any order, quantity, or importance, but rather are used to distinguish one element from another.

FIG. 1 illustrates a perspective view of a liquid ring fluid flow machine 10. The machine 10 includes a stationary housing 12 that includes an annular body, and a rotor 20 disposed within the housing 12. The annular housing 12 has an outer surface 14 and an inner surface 16 that defines an annular chamber 18 of the housing 12. The housing 12 may be formed from cast iron, ductile iron, and/or any other metallic material. In some embodiments, the housing 12 may be formed from a non-metallic material, e.g., plastic, to prevent corrosion of the annular housing 12.

The rotor 20 is eccentrically disposed in the chamber 18 with respect to the axis of the housing 12. The rotor 20 is often fixedly mounted on a shaft (not shown) extending into the housing 12. The shaft is generally stationary, and the rotor 20 is rotatably coupled thereon. The shaft may be hollow or solid. The rotor 20 can be driven to rotate about its axis by any suitable external driving means connected to the shaft, for example a motor. In one embodiment, the rotor 20 is eccentrically rotatably mounted within the chamber 18 of the housing 12.

The rotor 20 includes a core (or a hub) 22 and a plurality of vanes 24 extending radially outward from the core 22, and mounted circumferentially about the core 22. A cylindrical bore 23 extends into the core 22, and the shaft extends through the bore 23. The core 22 is fixedly mounted to the shaft. The shape, size, and geometry of the vanes 24 may vary depending on the end use applications and requirements, as known in the art.

As noted, the rotor 20 is eccentrically disposed within the chamber 18 of the housing 12. The eccentricity "ecr" of the housing 12 with respect to the rotor 20 is given by the formula:

$$ecr \leq (1-c)/3$$

wherein ecr=e/R, where 'e' is the distance between the rotor axis and the housing axis and 'c' is the ratio of the radius of the core 22 and the radius 'R' of the housing 12, (c=C/R).

The chamber 18 is arranged to receive a liquid (i.e., an operating liquid). Any suitable operating liquid can be used as known in the art. Some examples include water, an oil, and an acid. The selection of an operating liquid generally depends on the end use application of the machine. The annular housing 12 is partially filled with the operating liquid so that when the rotor 20 rotates, the rotor vanes 24 engage the operating liquid and direct the liquid to form a recirculating liquid ring 36 in proximity to the inner surface 16 of the housing 12. Various details regarding the formation and features of the liquid ring 36 are described in U.S. Pat. No. 5,636,523.

The liquid ring 36 diverges and converges in the radial direction relative to the rotor 20, and thus forms a plurality of regions or pockets 30 between the vanes 24 defined by an inner surface 38 of the liquid ring 36 and the rotor 20. Since these regions or pockets 30 rotate with the rotor 20, and since the rotor 20 is eccentric with respect to the liquid ring 36, the rotation of these pockets 30 results in a change in the radial lengths and the volumes of the pockets 30. A zone where the edges of the vanes 24 are disposed and rotate in an increasing proximity to the inner surface 16 of the housing 12 defines a compression zone that includes the pockets 30 of decreasing volume. A zone where the edges of vanes 24 are disposed and rotate in a decreasing proximity to the inner surface 16 of the housing defines an expansion zone that includes the pockets 30 of increasing volume.

The liquid ring machine 10 further includes a first cover plate and a second cover plate (not shown) to cover and seal the opposite ends (lateral sides) of the annular (i.e., cylindrical) chamber 18. These cover plates are secured to the housing 12 by way of screws or other appropriate means. Each of these cover plates has a port, i.e., a first port 26 and a second port 28, in fluid communication with the chamber 18. The machine 10 further includes a first supply pipe 32 and a second supply pipe 34. Each supply pipe 32 and 34 is in fluid communication with the chamber 18 through at least one of the first port 26 and the second port 28. A gas is often introduced through one of these supply pipes 32 or 34 to be compressed or expanded, and the resulting gas is discharged from the other supply pipe.

In some embodiments, a gas or air is sucked into the first port 26 (i.e., an inlet port) through the first supply pipe 32. As the rotor 20 and the liquid ring 36 rotate, the volume of the pockets 30 is reduced, and the gas or air is compressed. The compressed gas or air is discharged from the compression zone via the second port 28 (i.e., an outlet port) through the second supply pipe 34. In these embodiments, the machine 10 operates as a compressor.

In some other embodiments, a gas or air is provided in the second port 28 through the second supply pipe 34. Thus, the second port 28 is an inlet port, in these embodiments. With the rotation opposite to that shown in FIG. 1 of the liquid ring 36 and the rotor 20, the volume of the pockets 30 increases, and the gas or air expands in the expansion zone. The expanded gas is discharged via the first port 26 through the first supply pipe 32. The first port 26 acts as an outlet port. In these embodiments, the machine 10 operates as an expander.

Often, the liquid in the liquid ring machine 10, during operation, becomes heated. The cooling of the liquid may be desired in order to maintain the liquid at a low temperature, so that the gas contacting the liquid would be maintained at as low a temperature as possible. By maintaining the gas at a low temperature, less energy may be required for the compression of the gas, resulting in an increase in the efficiency of the machine thereof. A suitable way of cooling is to circulate a cooling liquid via the inlet port to the chamber between the vanes. This increases the heat exchange action between the cooling liquid and the gas. The cooling liquid may be same or different from the liquid used in the liquid ring. The cooling liquid is then discharged through the outlet port into a gas liquid separator. The separated liquid may be cooled by a direct or non-direct heat exchanger. The cooled liquid may return to the machine 10 to be used again for the cooling. This provides for an efficient cooling, and for close to isothermal compression, which increases the efficiency of the compressor machine.

Typically, as noted previously, a fluid friction i.e., liquid friction between the liquid ring 36 and the inner surface 16 of the annular housing 12 limits the efficiency of a compressor. Furthermore, the fluid friction between the liquid ring 36 and the inner surface 16 of the annular housing 12 increases over time because of the corrosion of the inner surface of the annular housing that is in contact with the liquid ring 36. The increased fluid friction requires an increase in the amount of power that is necessary to operate the machine. Thus the efficiency and life-span of a typical machine, e.g., a compressor, is undesirably decreased.

Embodiments of the present invention provide an alternative method and design to reduce/minimize the fluid friction between the liquid ring 36 and the inner surface 16 of the housing 12. According to the embodiments of the invention, the inner surface 16 of the annular housing 12 is covered by a hydrophobic coating 40 to repel the liquid of the liquid ring 36, and thus to reduce the fluid friction between the liquid ring 36 and the inner surface 16 of the housing 12.

Generally, hydrophobic coatings or materials are used specifically to be resistant to water. However, the hydrophobic coating 40, as used herein, refers to a coating that binds very weakly with the operating liquid that is used in the machine 10 to form the liquid ring 36, or to cause the liquid to bead-up rather than skinning (i.e., forming a coating or condensing at the surface). In some embodiments, when the operating liquid is an oil, the hydrophobic coating 40 includes an oleophobic material. The hydrophobic coating 40 usually has a contact angle of greater than about 90 degrees, and in some embodiments, greater than about 120 degrees, with the droplets of the operating liquid 36.

A hydrophobic material may be selected that would be suitable for the application of the liquid ring machine based on the end use application. For example, in a chemical plant, where various toxic, explosive and corrosive gases are involved, the liquid ring fluid flow machine should include various materials, for example an operating liquid and a hydrophobic coating that are chemically and thermally stable in the presence of those gases. Hydrophobic materials may include many well-known, commercially available polymers, e.g., silicone based materials, fluoropolymers, etc. Other suitable hydrophobic and superhydrophobic materials include rare earth oxides, carbonates, or carbon. Some examples are manganese oxide polystyrene ($MnO_2$/PS) nano-composite, zinc oxide polystyrene (ZnO/PS) nano-composite, precipitated calcium carbonate, carbon nanotube structure, and silica nano-coatings.

The hydrophobic coating 40 advantageously allows the liquid ring 36 to rotate in the annular housing 12 with no or little fluid friction. By reducing the fluid friction losses between the liquid ring 40 and the stationary annular housing 12, the liquid ring machine 10 requires less power to rotate the rotor 20 at a given required speed. Embodiments of the present invention, thus, provides a cost-effective means to maintain the efficiency and life-span of the machine 10 by reducing/preventing the fluid friction that occurs due to the contact of the liquid ring 36 with inner surface 12 of the annular housing 12.

While only certain features of the invention have been illustrated and described herein, many modifications and changes will occur to those skilled in the art. It is, therefore, to be understood that the appended claims are intended to cover all such modifications and changes as fall within the true spirit of the invention. Furthermore, all of the patents, patent applications, articles, and texts which are mentioned above are incorporated herein by reference.

The invention claimed is:

1. A liquid ring fluid flow machine comprising:

a stationary annular housing having an outer surface and an inner surface defining a chamber that is arranged to receive an operating liquid, wherein the operating liquid is an oil, a rotor having a core and a plurality of radially extending vanes eccentrically rotatably mounted within the chamber for directing the operating liquid into a recirculating liquid ring in the chamber in proximity to the inner surface of the housing, wherein the annular housing defines a compression zone where edges of the vanes rotate in increasing proximity to the inner surface of the housing and an expansion zone where edges of the vanes rotate in decreasing proximity to the inner surface of the housing; and an inlet port through which a gas is received and an outlet port through which an expanded gas is provided, the inlet port and the outlet port in fluid communication with the chamber, wherein the received gas is expanded in the expansion zone responsive to rotating the rotor to cause the edges of the vanes to rotate in decreasing proximity of the inner surface of the housing, and wherein the inner surface of the housing that is in contact with the recirculating liquid ring is covered by a hydrophobic coating, comprised of an oleophobic material.

2. The liquid ring fluid flow machine of claim 1, further comprising a first cover plate sealing one end of the chamber and a second cover plate sealing another end of the chamber.

3. The liquid ring fluid flow machine of claim 1, wherein the core is rotatably mounted on a shaft extending through at least a first cover plate or a second cover plate.

4. The liquid ring fluid flow machine of claim 1, further comprising a first supply pipe and a second supply pipe, each in fluid communication with at least one of the inlet port and the outlet port.

5. The liquid ring fluid flow machine of claim 1, wherein the hydrophobic coating has a contact angle of greater than 90 degrees relative to droplets of the operating liquid.

6. The liquid ring fluid flow machine of claim 5, wherein the hydrophobic coating has a contact angle of greater than 120 degrees relative to droplets of the operating liquid.

* * * * *